US005743836A

United States Patent [19]

Lo

[11] Patent Number: 5,743,836

[45] Date of Patent: Apr. 28, 1998

[54] STRUCTURE OF BABY WALKER

[76] Inventor: Yin-Ying Lo, No. 59-16, Chiu-She Lane, Chiu-She Li, Pei-Tun Dist., Taichung City, Taiwan

[21] Appl. No.: 736,686

[22] Filed: Oct. 25, 1996

[51] Int. Cl.[6] ..... A63B 26/00

[52] U.S. Cl. ..... 482/66; 280/87.051

[58] Field of Search ..... 482/66, 68; 280/87.021, 280/87.051, 47.41, 1.191; 297/5

[56] References Cited

U.S. PATENT DOCUMENTS

| | | | |
|---|---|---|---|
| 5,302,163 | 4/1994 | Fermaglich et al. | 482/66 |
| 5,409,437 | 4/1995 | Lauro et al. | 280/87.051 X |
| 5,433,682 | 7/1995 | Fermaglich et al. | 482/66 |
| 5,518,475 | 5/1996 | Garland | 482/66 X |

*Primary Examiner*—Brian L. Johnson
*Assistant Examiner*—Michael Mar
*Attorney, Agent, or Firm*—Morton J. Rosenberg; David I. Klein; Jun Y. Lee

[57] ABSTRACT

A baby walker including a seat, an annular base frame, two pairs of wheels symmetrically mounted on the base frame, two links connected in parallel between the two pairs of wheels above the base frame, and two crossed supports connected between the links and the seat, wherein the base frame is comprised of an annular upper plate and an annular bottom plate; each wheel is comprised of a circular bottom shell fixedly coupled to the annular upper plate of the base frame and moved with it along the annular bottom plate of the base frame, and an upper shell pivoted to the circular bottom shell and having an arm pivoted to one end of one link.

5 Claims, 9 Drawing Sheets

STRUCTURE OF BABY WALKER

BACKGROUND OF THE INVENTION

The present invention relates to baby walkers for assisting baby to walk, and relates more particularly to such a baby walker which is prohibited from a linear motion and, allows to be turned through 360° angle at a fixed place.

FIG. 1 shows a baby walker according to the prior art, which is generally comprised of a bottom frame 12 equipped with rollers 13, a seat assembly 10 supported on the bottom frame 12, and two crossed supports 11 connected between the bottom frame 12 and the seat assembly 10. When a baby sits in the seat assembly 10 and kicks the ground with the foot, the baby walker is forced to move forwards. This structure of baby walker cannot be limited to a rotary motion at a fixed point. Because the baby walker may move in all directions, there must be a person to attend the baby. Furthermore, when moving over an obstacle, the baby walker may be forced to fall (see FIG. 2).

SUMMARY OF THE INVENTION

It is the main object of the present invention to provide a baby walker which is allowed to be turned through 360° angle at a fixed place. According to the present invention, the baby walker comprises a seat, an annular base frame, two pairs of wheels symmetrically mounted on the base frame, two links connected in parallel between the two pairs of wheels above the base frame, and two crossed supports connected between the links and the seat, wherein the base frame is comprised of an annular upper plate and an annular bottom plate; each wheel is comprised of a circular bottom shell fixedly coupled to the annular upper plate of the base frame and moved with it along the annular bottom plate of the base frame, and an upper shell pivoted to the circular bottom shell and having an arm pivoted to one end of one link. When in use, the baby walker is prohibited from a linear motion. When the baby kicks the floor with the foot, the links are forced to move relative to the arms of the upper shells of the wheels, and the bottom shells of the wheels with the upper annular plate of the base frame are forced to move relative to the annular bottom plate of the base frame through 360° angle. Because the baby walker is prohibited from steering linearly, it will not be obstructed to fall by an obstacle. Because the seat can be turned through 360° at a fixed place, the movement of the baby is not hindered. Therefore, this structure of baby walker is safe in use.

BRIEF DESCRIPTION OF THE DRAWINGS

FIG. 8 is a schematic drawing showing the links moved with the wheels relative to the base frame according to the present invention; and.

DETAILED DESCRIPTION OF THE PREFERRED EMBODIMENT

Figure 1:
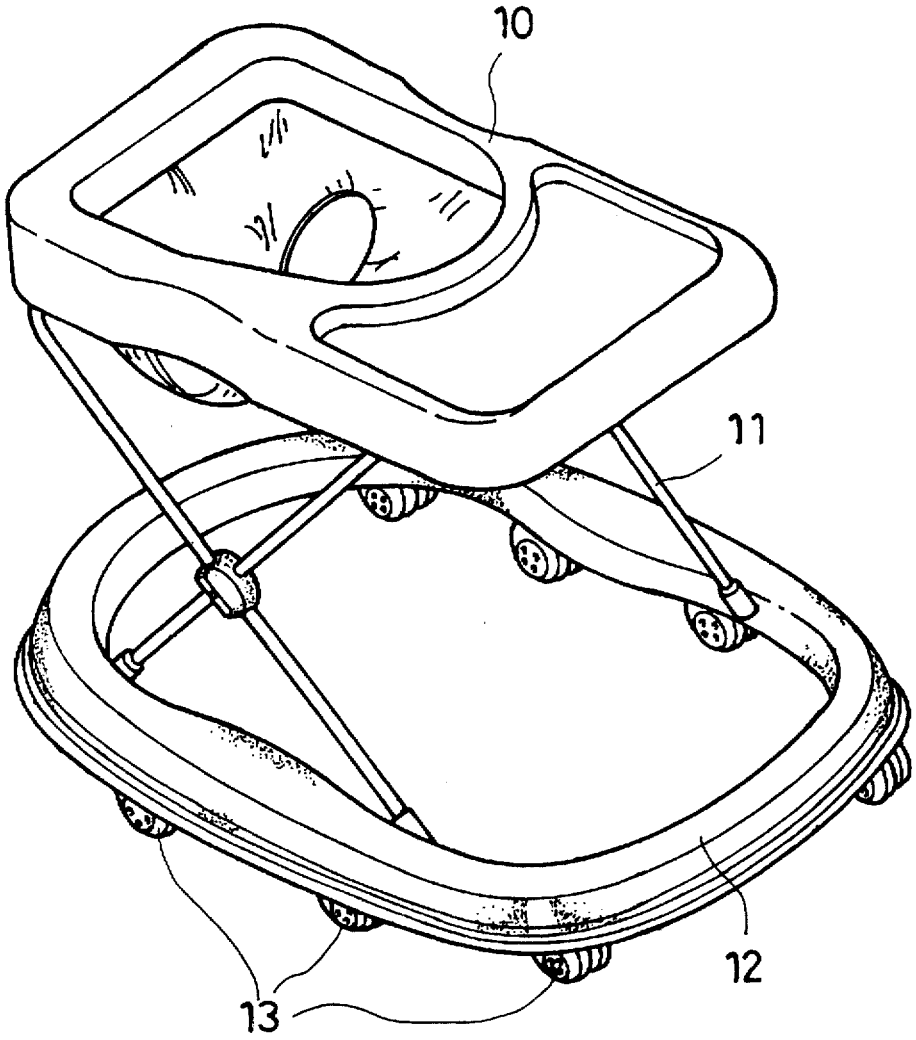
FIG.1 PRIOR ART
FIG. 1 is an elevational view of a baby walker according to the prior art.
Figure 2:
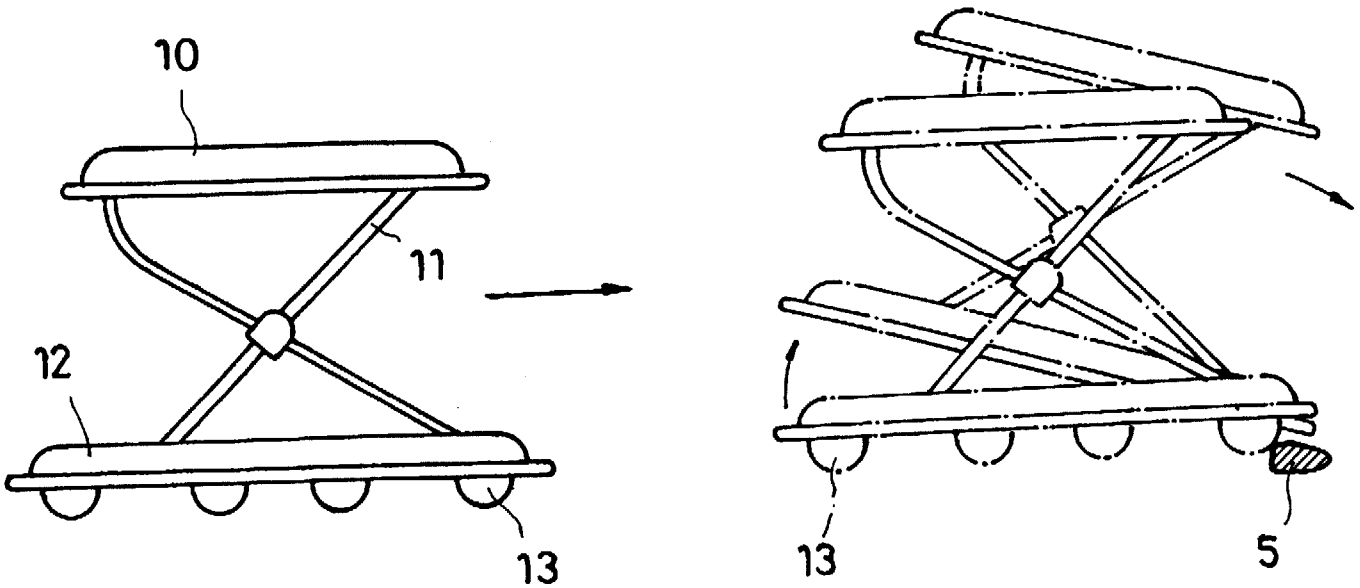
FIG.2 PRIOR ART
FIG. 2 is a schematic drawing showing an obstacle obstructed the movement of a baby walker according to the prior art.
Figure 3:
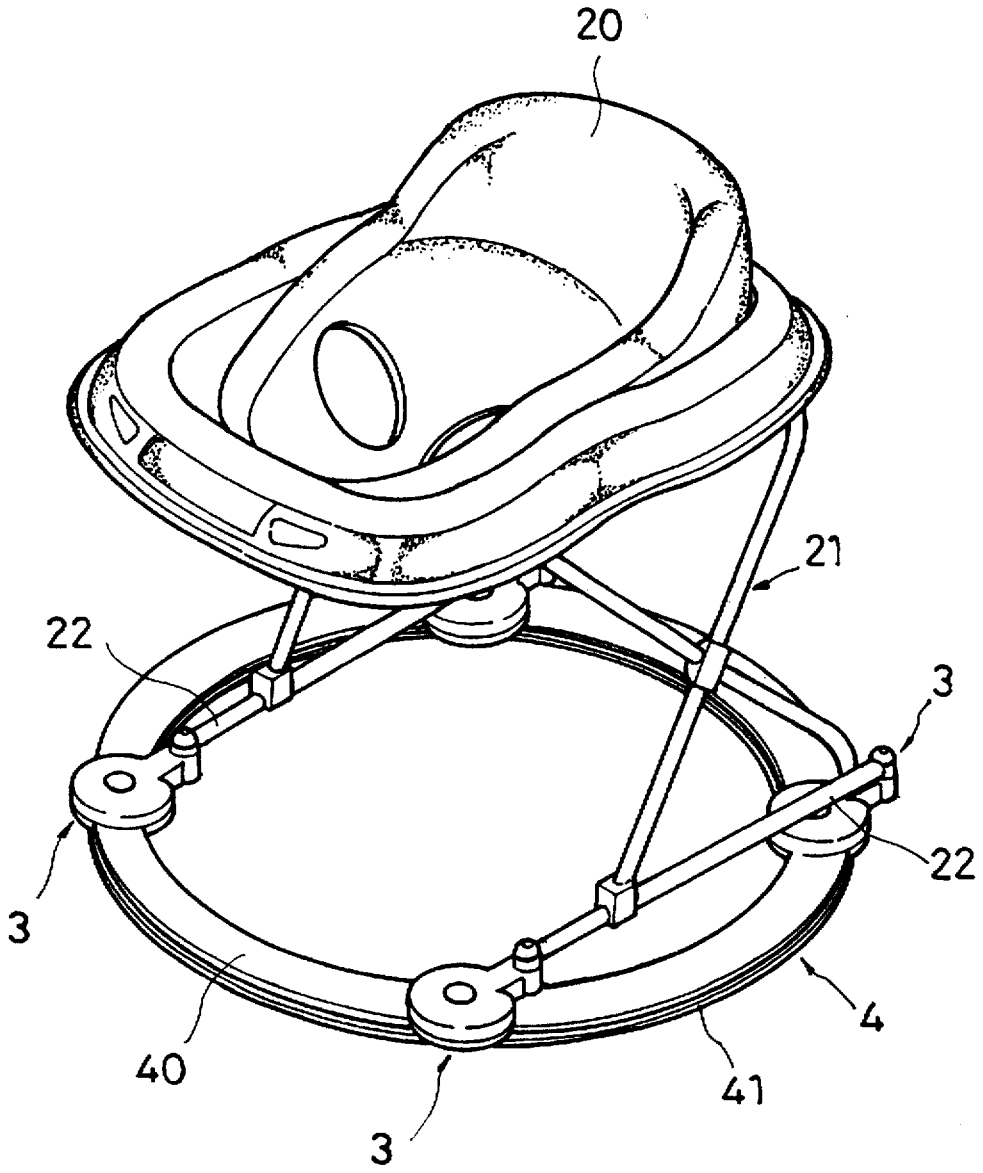
FIG. 3 is an elevational view of a baby walker according to the present invention.
Figure 4:
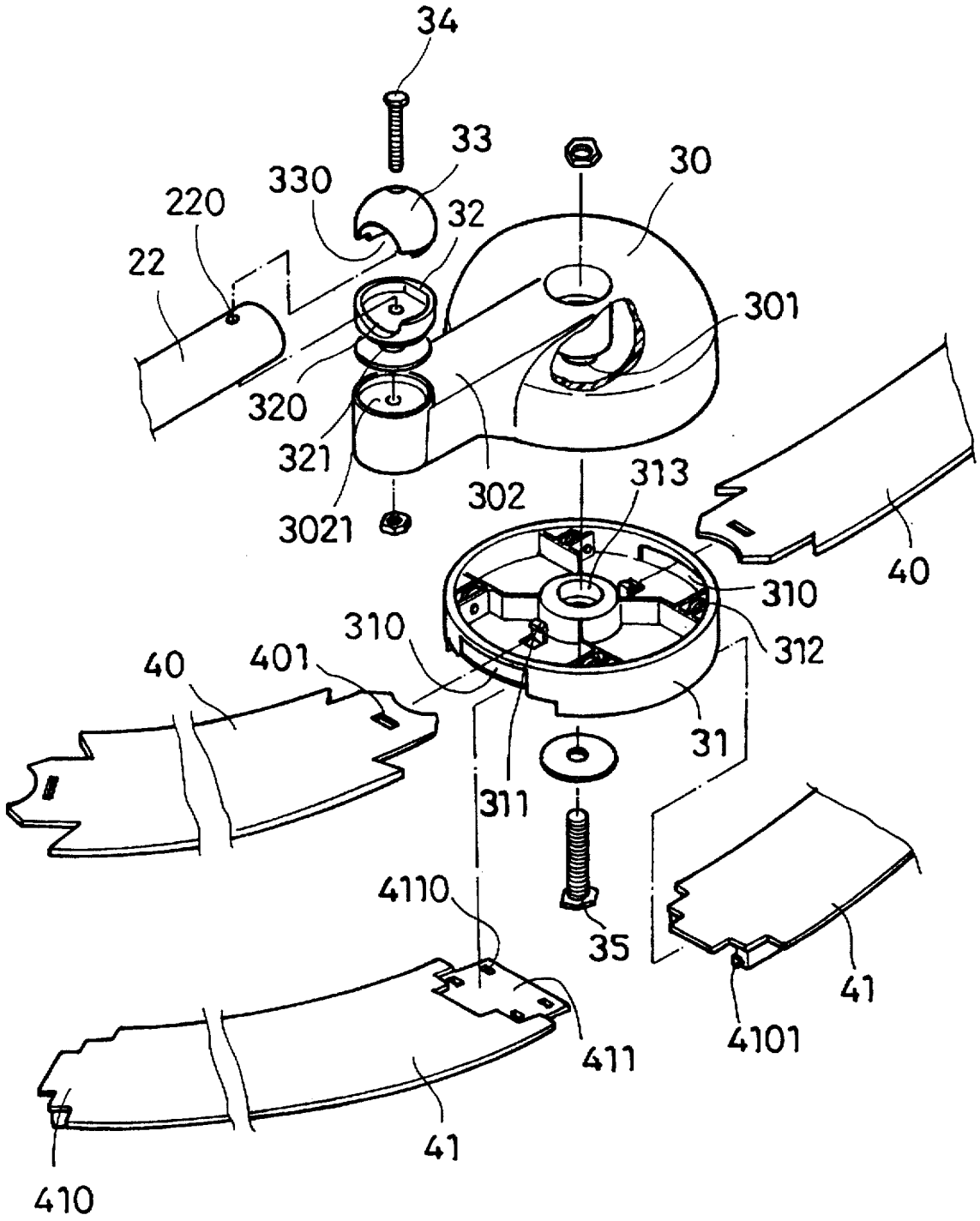
FIG. 4 is an exploded view of one wheel and a part of the base frame according to the present invention.

Referring to FIGS. from 3 to 7, a baby walker in accordance with the present invention, is generally comprised of a seat 20, an annular base frame 4, two pairs of wheels 3 symmetrically mounted on the base frame 4, two links 22 connected in parallel between the two pairs of wheels 3 above the base frame 4, and two crossed supports 21 connected between the links 22 and the seat 20.

Figure 5:
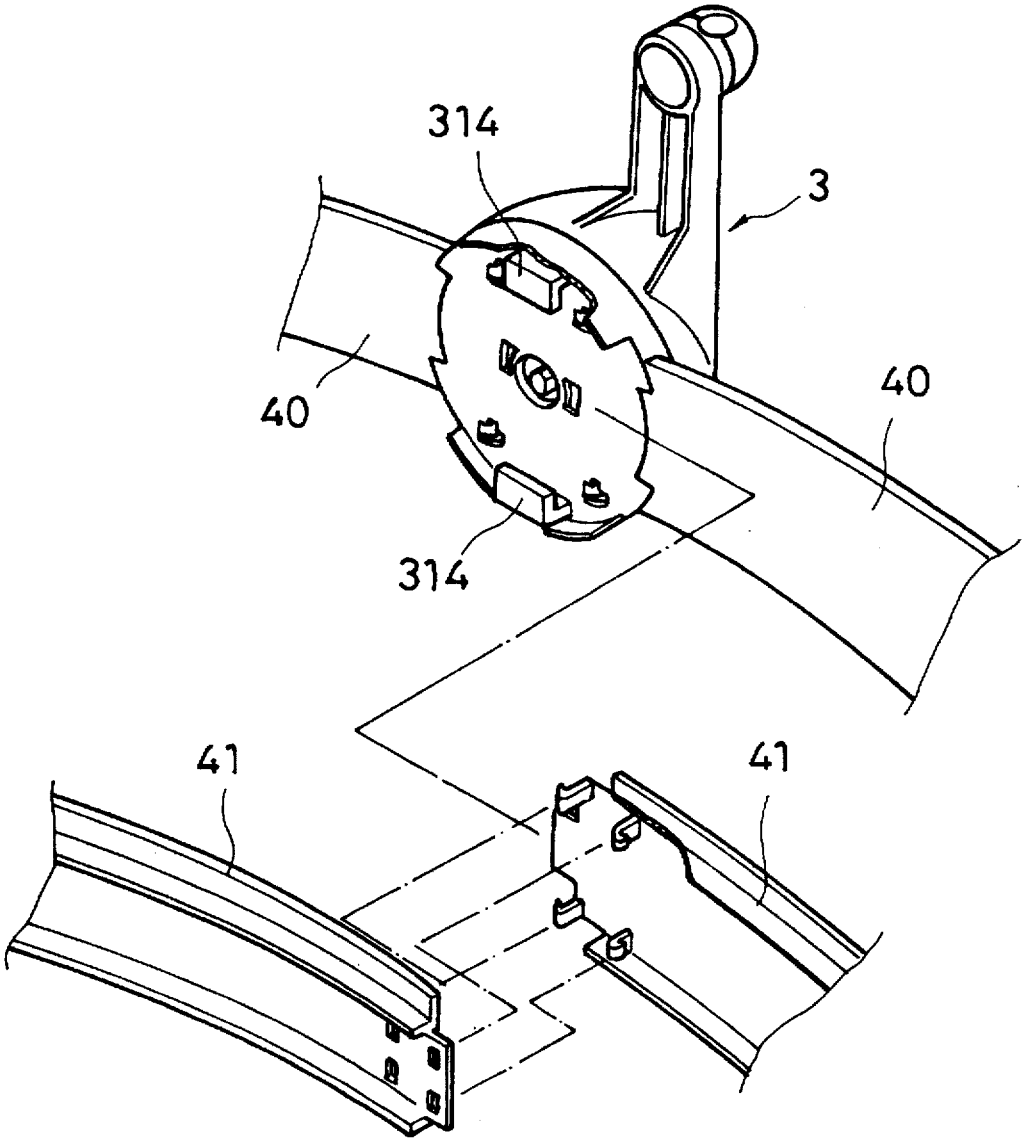
FIG. 5 shows one wheel coupled to the upper sections of the base frame relative to the lower sections according to the present invention.
Figure 6:
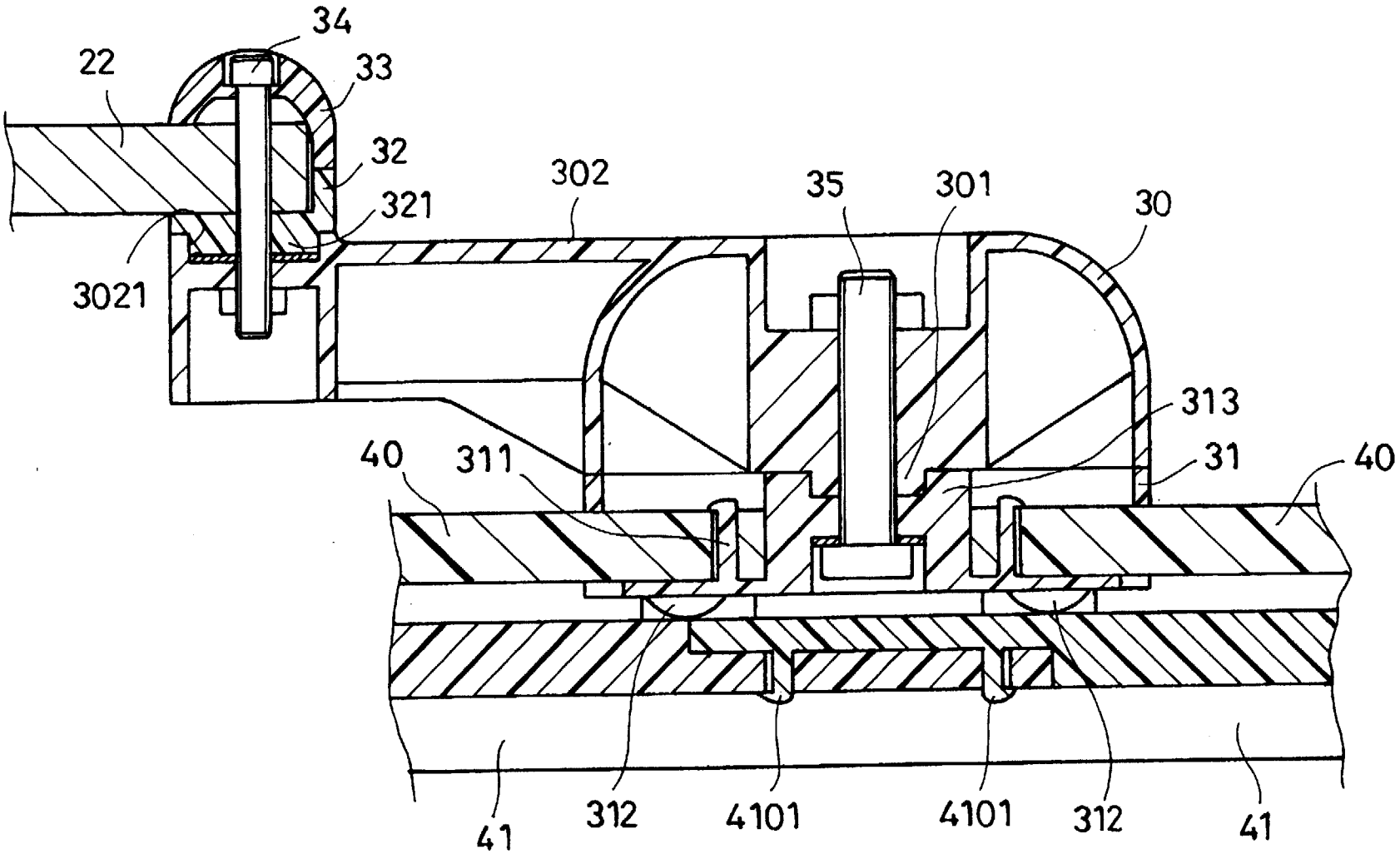
FIG. 6 is a sectional assembly view in an enlarged scale of FIG. 4.
Figure 7:
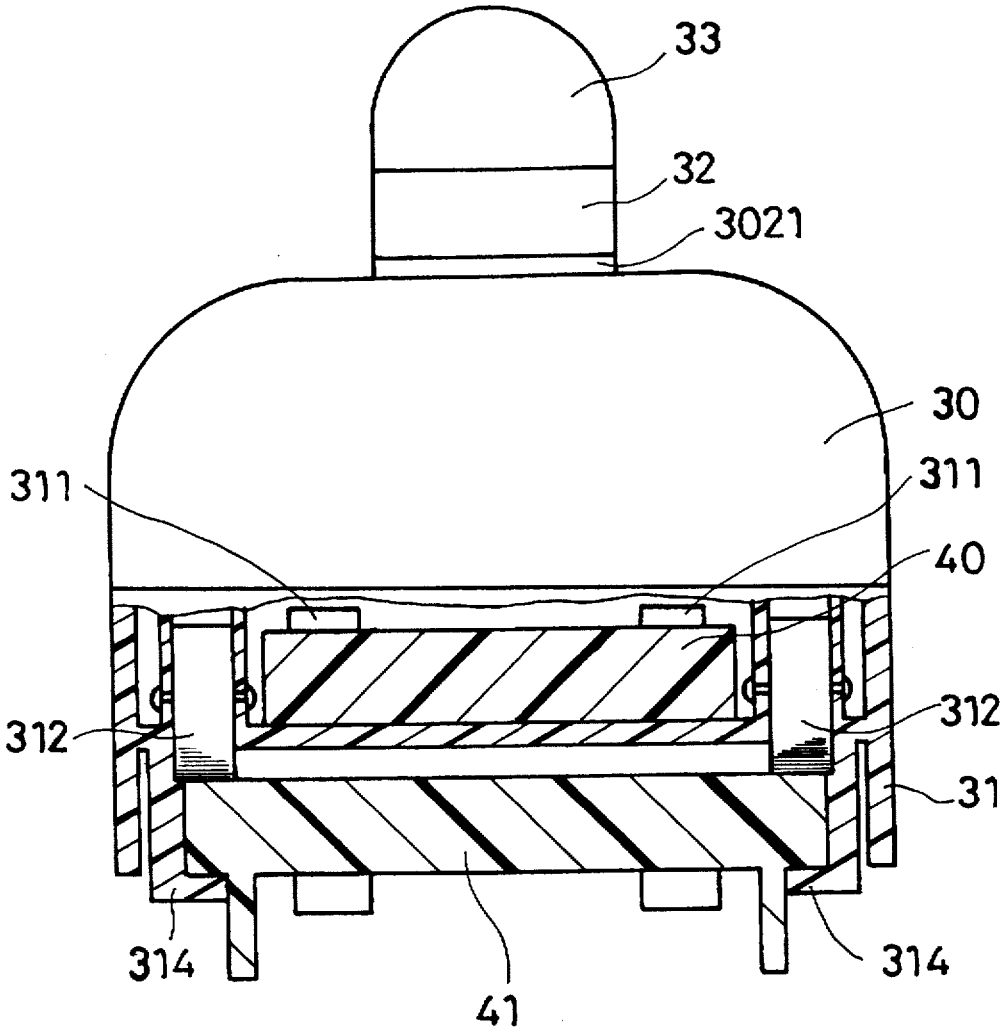
FIG. 7 is a sectional view of a part of the present invention, showing the wheel coupled to the base frame.

Each wheel 3 is comprised of a hemispherical upper shell 30, and a circular bottom shell 31. The upper shell 30 comprises a center coupling barrel 301, and an arm 302 perpendicularly extended from the periphery and terminating in a vertical axle housing 3021. A coupling member 32 and a cap 33 are fastened to the vertical axle housing 3021 by a screw bolt 34 to hold one end of one link 22. When the coupling member 32 and the cap 33 are installed, they can be turned with the connected link 22 about the screw bolt 34. The coupling member 32 has a bottom coupling section 321 inserted into the vertical axle housing 3021, and a half-round notch 320 at the top. The cap 33 is shaped like a dome, having a half-round notch 330 matched with the half-round notch 320 of the coupling member 32. When the coupling member 32 and the cap 33 are connected together, the half-round notches 320, 330 form a circular hole which receives one end of the corresponding link 22, which has a through hole 220 through which the screw bolt 34 passes. The circular bottom shell 31 comprises a center coupling barrel 313 connected to the center coupling barrel 301 by a screw bolt 35 for permitting the upper shell 30 and the bottom shell 31 to be respectively turned about the screw bolt 35, two hooks 311 raised from the inside at two opposite locations relative to the center coupling barrel 301, four rollers 312 equiangularly spaced from one another on the inside, two horizontal coupling holes 310 respectively disposed through the periphery at two opposite sides in alignment with the hooks 311, and two bottom angle rails 314 (see FIG. 5).

Referring to FIGS. from 3 to 6, the annular base frame 4 is comprised of a plurality of smoothly arched upper sections 40 respectively connected between each two wheels 3, and a plurality of smoothly arched lower sections 41 respectively connected to one another and coupled to the bottom shells 31 of the wheels 3. Each upper section 40 has a coupling lug 401 at each end inserted into one horizontal coupling hole 310 of the bottom shell 31 of one wheel 3 and hooked on one hook 311 of the bottom shell 31 of the corresponding wheel 3. Each lower section 41 has a first coupling flange 410 at one end, and a second coupling flange 411 at an opposite end. The first coupling flange 410 has downward hooks 4101. The second coupling flange 411 has retaining holes 4110. By hooking the downward hooks 4101 of the first coupling flange 410 of one lower section 41 in the retaining holes 4110 of the second coupling flange 411 of another, the lower sections 41 are connected into an annular structure. When the lower sections 41 are connected together, they are closely attached to the bottom side of the bottom shell 31 of each wheel, and retained in place by the bottom angle rails 314. When assembled, the rollers 312 of the bottom shell 31 of each wheel 3 are supported on the lower sections 41, and can be moved with the upper sections 40 along the lower sections 41.

Figure 8:
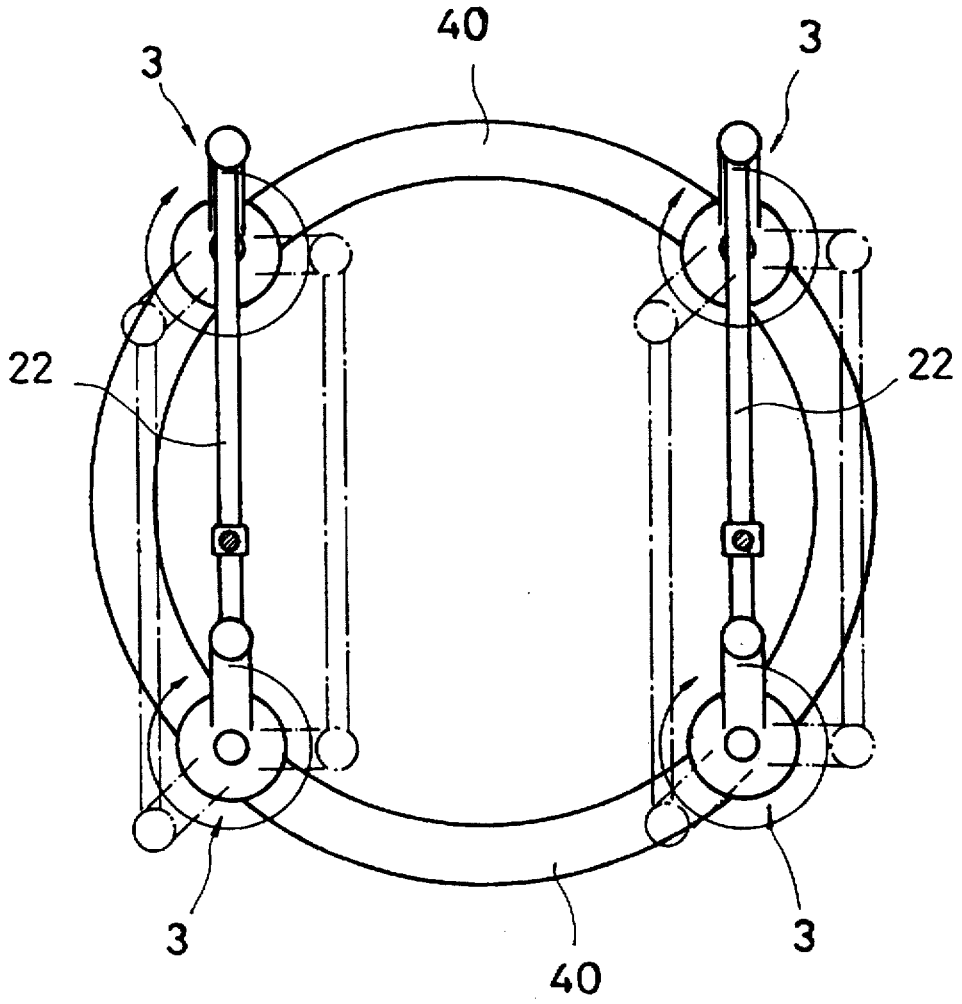
Figure 9:
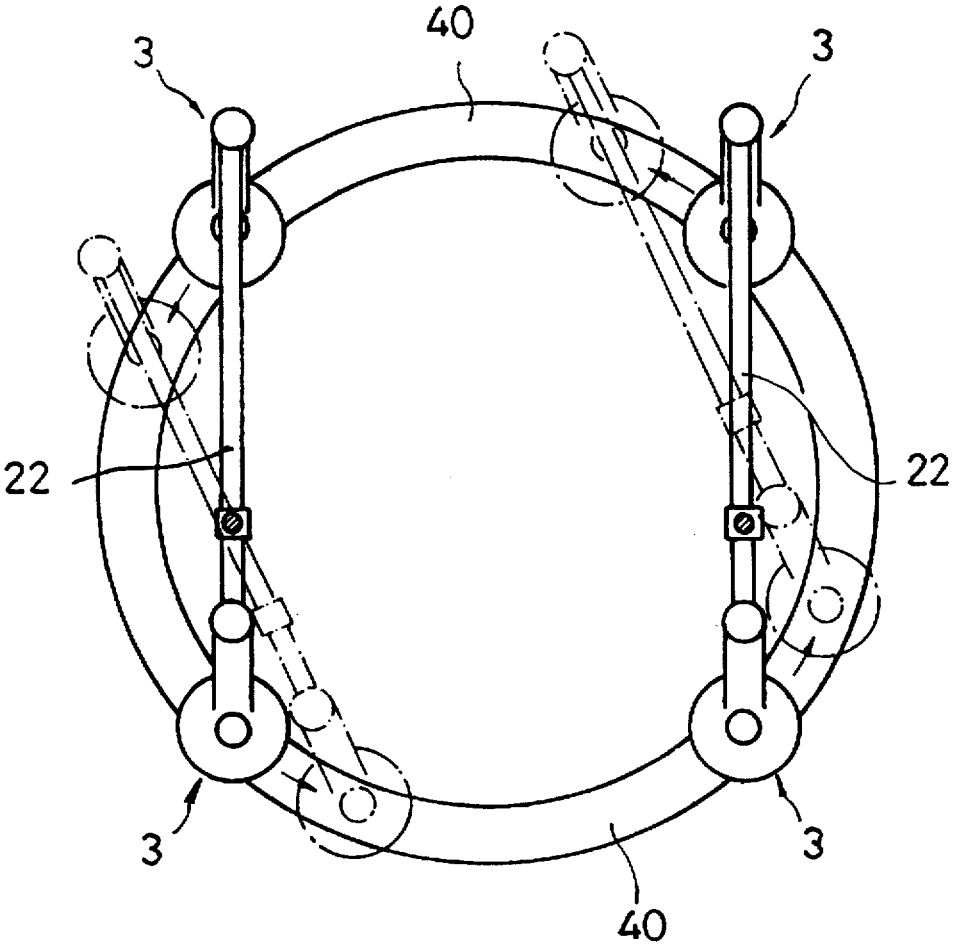
FIG. 9 is a schematic drawing showing the wheels and the upper sections of the base frame moved relative to the lower sections of the base frame according to the present invention.

Referring to FIGS. 8 and 9, and FIGS. 3 and 6 again, when in use, the lower sections 41 of the base frame 4 are placed on the floor. When the baby is put in the seat 20, and kicks the floor with the foot, the seat 20, the crossed supports 21 and the links 22 are forced to move together. Because the links 22 are coupled to the wheels 3, the arms 302 of the wheels 3 are turned forwards when the links 22 are moved forwards, or turned backwards when the links 22 are moved backwards. Because the axle housing 3021 of the arm 302 can be turned relative to the corresponding coupling member 32, the corresponding link 22 and the upper shell 30 of each wheel 3 can be turned relative to the corresponding bottom shell 31, and the bottom shell 31 with the upper sections 40 of the base frame 4 can be moved along the lower sections 41 of the base frame 4, the seat 20 can be turned through 360° angle when the baby kicks the floor.

It is to be understood that the drawings are designed for purposes of illustration only, and are not intended as a definition of the limits and scope of the invention disclosed.

What the invention claimed is:

1. A baby walker comprising a seat, an annular base frame, two pairs of wheel assemblies symmetrically mounted on said base frame, two links connected in parallel between said two pairs of wheel assemblies above said base frame, and two crossed supports connected between said links and said seat, wherein each of said wheel assemblies is comprised of a hemispherical upper shell, a circular bottom shell, a coupling member, and a dome-like cap, said upper shell comprising a center coupling barrel, and an arm perpendicularly extended from a periphery and terminating in a vertical axle housing, said coupling member and said dome-like cap being pivotably coupled to the axle housing of said arm by a screw bolt to hold one end of one of said links, each link having opposite ends pivotally coupled to the vertical axle housings of each pair of said wheel assemblies said coupling member having a bottom coupling section journalled in the vertical axle housing of said arm and a half-round notch at a top side thereof, said cap having a half-round notch matched with the half-round notch of said coupling member into a circular hole which receives one end of the corresponding link, said circular bottom shell comprising a center coupling barrel pivotably connected to the center coupling barrel of said upper shell by a screw bolt for permitting said upper shell to be turned relative to said bottom shell;

said annular base frame is comprised of an annular upper plate fixedly coupled to the bottom shells of said wheel assemblies, and an annular bottom plate coupled to the bottom shells of said wheel assemblies and imparting an annular track for permitting said wheel assemblies and said annular upper plate to be moved thereon through 360° angle, and rollers positioned between the bottom shell of each of said wheel assemblies and said annular bottom plate for permitting rolling movement therebetween.

2. The baby walker of claim 1 wherein the annular bottom plate of said annular base frame is comprised of a plurality of smoothly arched sections respectively connected to one another and coupled to the bottom shells of said wheel assemblies, each section of said annular bottom plate having a first coupling flange at one end, and a second coupling flange at an opposite end, said first coupling flange having a plurality of downward hooks, said second coupling flange having a plurality of retaining holes, the sections of said annular bottom plate being connected to one another by hooking the downward hooks of the first coupling flange of one section in the retaining holes of the second coupling flange of another.

3. The baby walker of claim 1 wherein the bottom shell of each of said wheel assemblies comprises two hooks bilaterally disposed on the inside, and two horizontal coupling holes disposed through the periphery at two opposite sides in alignment with the hooks; the annular upper plate of said annular base frame comprises a coupling lug at each end inserted into one horizontal coupling hole of the bottom shell of one wheel assembly and hooked on one hook of the bottom shell of the corresponding wheel assembly.

4. The baby walker of claim 1 wherein the bottom shell of each of said wheel assemblies has two bottom angle rails symmetrically bilaterally raised from a bottom side thereof, and coupled to the annular bottom plate of said annular base frame at two opposite sides.

5. The baby walker of claim 1 wherein the bottom shell of each of said wheel assemblies is equipped with two symmetrical pairs of equiangularly spaced rollers respectively supported on the annular bottom plate of said annular base frame.

* * * * *